US006968967B1

(12) United States Patent
Burns

(10) Patent No.: US 6,968,967 B1
(45) Date of Patent: Nov. 29, 2005

(54) CARRYING POUCH FOR SMALL ARTICLES

(75) Inventor: Michael W. Burns, Hudson, OH (US)

(73) Assignee: Quikey Manufacturing Co., Inc., Akron, OH (US)

( * ) Notice: Subject to any disclaimer, the term of this patent is extended or adjusted under 35 U.S.C. 154(b) by 208 days.

(21) Appl. No.: 10/191,830

(22) Filed: Jul. 10, 2002

(51) Int. Cl.[7] ..... B65D 21/02
(52) U.S. Cl. ..... 220/23.87; 206/38.1
(58) Field of Search ..... 206/38, 38.1, 234, 206/237, 232, 581, 259, 540; 224/676; 150/151, 150/152; 220/23.87, 23.91

(56) References Cited

U.S. PATENT DOCUMENTS 1,344,635 A * 6/1920 Hill ..... 206/259
1,579,081 A * 3/1926 Coleman ..... 206/90
1,982,855 A * 12/1934 Brunner et al. ..... 206/95
2,483,460 A * 10/1949 Harris ..... 206/92
2,892,537 A * 6/1959 Schwartz ..... 206/38
3,958,690 A * 5/1976 Gee, Sr. ..... 206/232
4,449,474 A * 5/1984 Mariol ..... 116/2
4,566,590 A * 1/1986 Manning et al. ..... 206/232
4,934,528 A * 6/1990 Miller et al. ..... 206/235
5,330,056 A * 7/1994 de la Rocha ..... 206/581
5,913,419 A * 6/1999 Doodson ..... 206/308.1
6,125,998 A * 10/2000 Batista ..... 206/38

OTHER PUBLICATIONS

Quikey Promotional Products Brochure, 2002.

* cited by examiner

*Primary Examiner*—Joseph C. Merek
(74) *Attorney, Agent, or Firm*—Renner, Kenner, Greive, Bobak, Taylor & Weber

(57) ABSTRACT

A carrying pouch for small articles which include an openable cover that is formed with front and rear faces joined by opposed edge walls and a bottom wall, all contiguous to each other to form an open ended pouch. The articles are receivable within the pouch and one face of the pouch has a through opening therein configured and dimensioned complementally with the cover of the article to permit opening and closing of the article when it is received within the pouch. A tab for receiving a key ring or suitable attachment piece may also be formed integrally with the pouch.

4 Claims, 2 Drawing Sheets

CARRYING POUCH FOR SMALL ARTICLES

RELATED PATENT APPLICATIONS

This invention is the subject of U.S. design patent application entitled Carrying Pouch for Small Articles filed Jul. 8, 2002, as Ser. No. 29/163,489.

FIELD OF THE INVENTION

This invention relates in general to carrying pouches and relates in particular to a carrying pouch for small objects wherein, in additional to providing a carrying receptacle for the object, the object may be utilized without removing it from the pouch.

BACKGROUND OF THE INVENTION

It is known in the prior art, as illustrated in FIG. 6 of the drawings, to fabricate pouches or article receiving receptacles from soft material such as vinyl or other suitable materials, so as to form a pouch or receptacle having an open end for receipt of the article.

As illustrated in FIG. 6 of the drawings, such a receptacle for receipt of a mirror is shown as an example the prior art and in that case, the material is translucent so as to facilitate view to the article contained inside. It is also known that such receptacle may be opaque and that advertising or other indicia may be printed on the exterior of the pouch or receptacle.

While such receptacles or pouches have received wide acceptance in the field, the present invention is intended to accommodate articles which are intended to be used while still inside the pouch as contrasted, for example, to the article of FIG. 6 wherein the mirror would be removed from the pouch in use.

It is also the case that some of the articles which are carried in pouches of this general nature may have the capability of being opened to access the interiors of the receptacles themselves and, thus, to gain access to the contents thereof. In that case, it is heretofore been the case that in order to access the contents of the receptacle, it is necessary to remove the same from the pouch. The present invention is intended to overcome that difficulty.

SUMMARY OF THE INVENTION

It has been found that the above stated object of the invention can be achieved by providing a carrying pouch of a suitable material having a main body with front and rear walls, opposed edge walls and a bottom wall all integral with each other to form an open-ended container.

It has further been found that the front face of the body can be provided with a through opening, the dimensions and configuration of which are complemental to the dimensions and configuration of the openable portion of the receptacle so that access to the interior thereof can be obtained without removing the same from the pouch.

It has further been found that the desirability of such a pouch can be enhanced by the provision of an integral tab projecting from one of the edge walls of the pouch and capable of receiving a ring for carrying keys or the like.

It accordingly becomes the principal object of this invention to provide a carrying pouch of the character above-described with other objects thereof becoming more apparent upon a reading of the following brief specification considered and interpreted in view of the accompanying drawings.

BRIEF DESCRIPTION OF THE PREFERRED EMBODIMENTS

Figure 1:
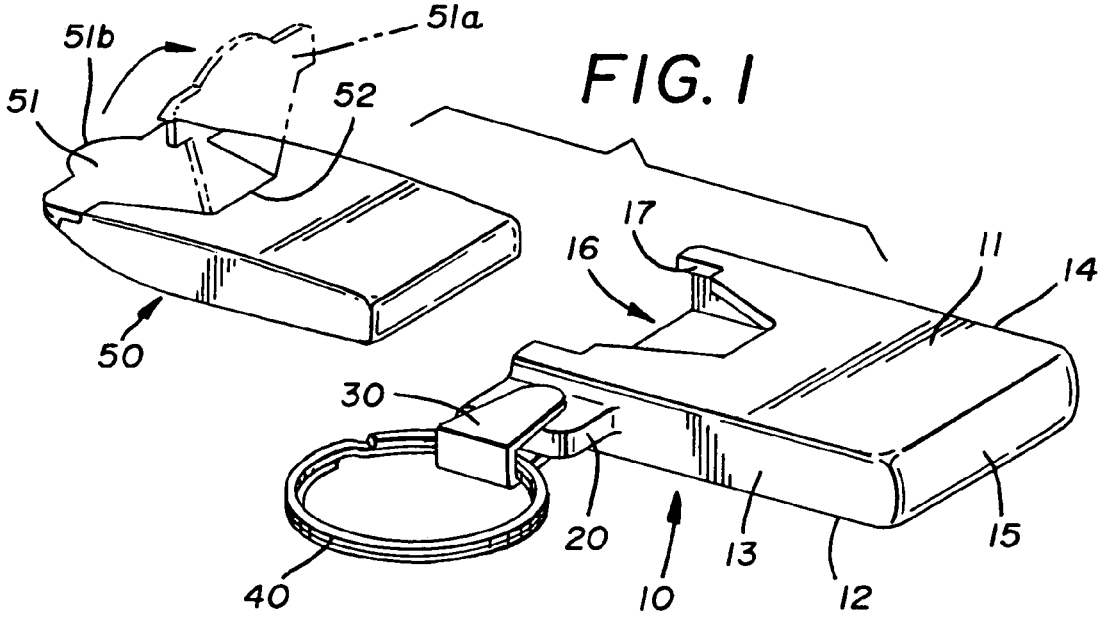
FIG. 1 is an exploded perspective view showing the improved pouch and the receptacle intended to be received within the pouch.

Referring first then to FIG. 1 of the drawings, it will be seen that the improved pouch, generally indicated by the numeral 10, includes front and rear walls 11 and 12, opposed edge walls 13 and 14 and bottom wall 15. As previously noted, it is contemplated that the pouch of the present invention would be dipped from vinyl or some other suitable material and that the walls would be contiguous and integral with each other so as to form a hollow pouch for receiving articles with an open end 16 at the opposed end of the pouch, from the bottom wall 15.

Still referring to FIGS. 1 through 4 of the drawings, it will be noted that an integral tab 20 is also preferably formed with the body and projects from one of the edge walls 13 or 14 and that this tab is apertured as at 21 for receipt of a ring receiving member 30 which is pivotally attached to the tab by the pin 31 received in the apertures 21 of the opposed sides of the tab.

A ring suitable for receipt of keys or the like and indicated by the numeral 40 is then received on the U-shaped tab 30 so that the user may or may not, as desired, carry various keys or other objects thereof thereon.

Figure 2:
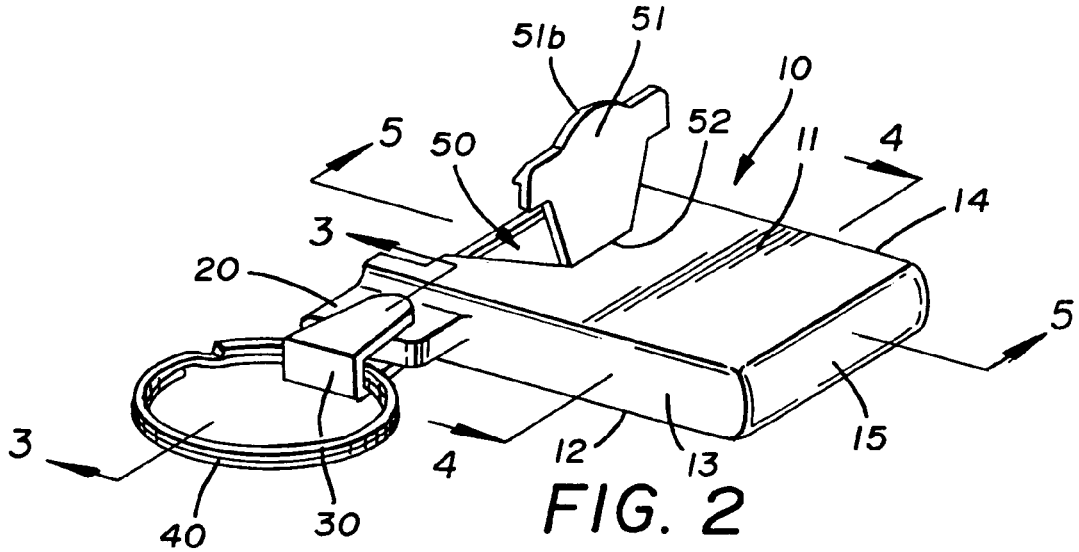
FIG. 2 is a view similar to FIG. 1 with the receptacle inserted into the pouch.
Figure 3:
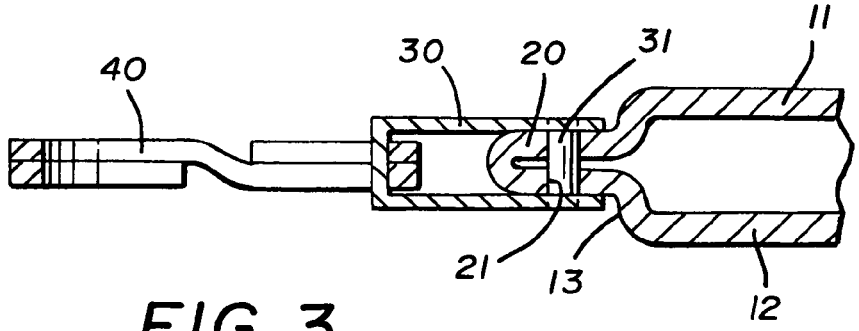
FIG. 3 is a sectional view along the line 3—3 of FIG. 2.
Figure 4:
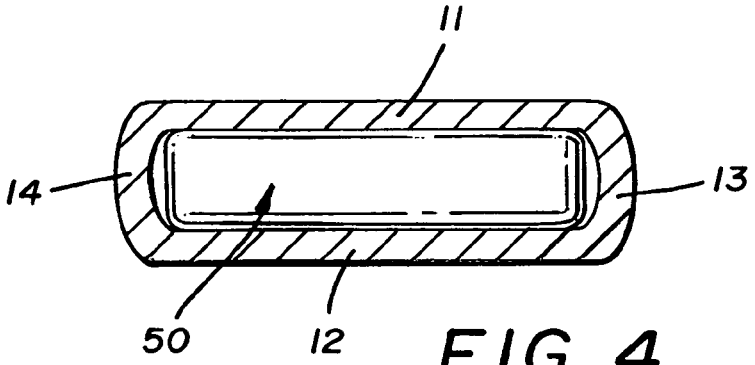
FIG. 4 is a sectional view along the line 4—4 of FIG. 2.
Figure 5:
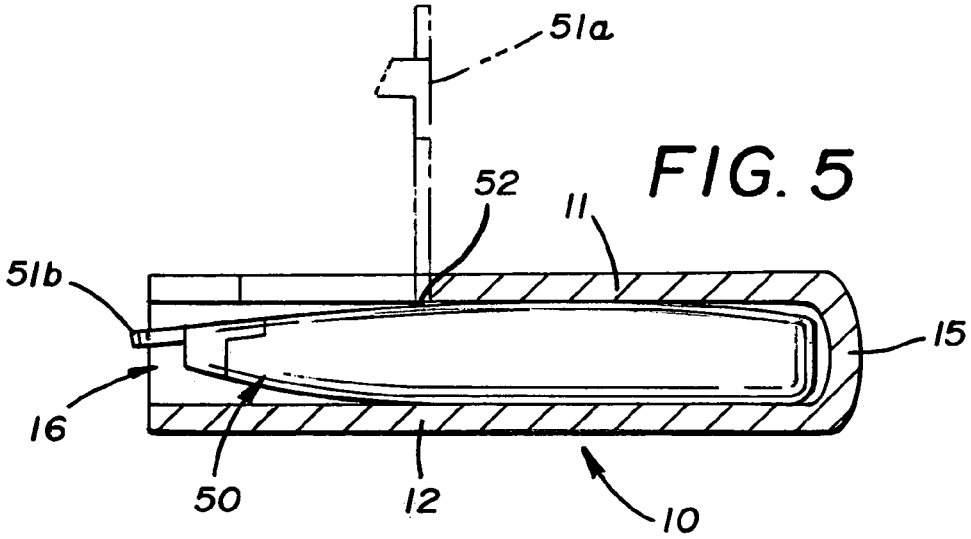
FIG. 5 is a sectional view along the line 5—5 of FIG. 2.
Figure 6:
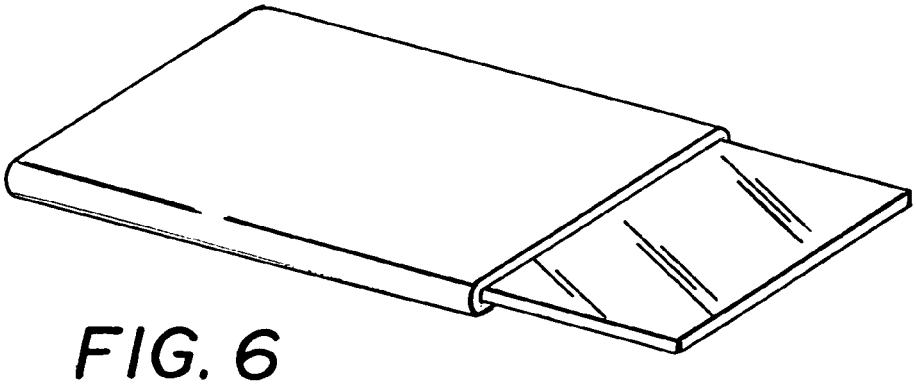
FIG. 6 PRIOR ART
FIG. 6 is a perspective view of one example of the prior art.

With reference to FIGS. 1 and 2 of the drawings, it will be noted that the small article of the general type for which this invention is designed is generally indicated by the numeral 50. That would generally, but not necessarily be made of hard, plastic material, and has an openable cover 51 for access to the contents of the article 50.

As shown in FIG. 1 of the drawings, movement of the cover 51 from the full-line or closed position of FIG. 1 to the open or broken-line position of FIG. 1 and indicated by the numeral 51*a* is made possible by providing a hinge 52 at the point the cover 51 and the main body of article 50 are connected. This is simply accomplished by engaging the projection 51*b* of the cover with the finger or thumb and snapping the cover open to the broken-line position indicated by the numeral 51*a*.

It will be seen that the front wall 11 of the pouch 10 has a through opening therein indicated by the numeral 17 as previously noted. It will also be apparent from the drawings that this opening is dimensioned and configured to match the configuration of the cover 51 of the receptacle 50.

In this fashion, if the article 50 is received within the pouch as shown in FIG. 2, it is readily possible to open the cover 51 and access the contents of the article. Alternatively, of course, the user could simply remove the receptacle 50 from the pouch for use, but it is believed more efficient to simply access the contents while the receptacle is received within the pouch.

While a full and complete description of the invention has been set forth in accordance with the dictates of the Patent Statutes, it should be understood that modifications can be resorted to without departing from the spirit hereof or the scope of the appended claims.

In that regard, the particular material from which the pouch is fabricated is a matter of choice and the invention is not intended to be limited to any particular material.

Similarly, while a particular configuration for cover 51 for the article 50 has been illustrated herein, it will be understood that the opening 17 in the front face 11 of the pouch could be modified to accommodate different configurations of the cover of the article.

What is claimed is:

1. In combination, a carrying pouch and a receptacle received in the carrying pouch; said receptacle having a main body and a cover hingedly attached to said main body, said cover being movable between opened and closed positions; said carrying pouch having opposed front and rear walls, opposed edge walls, and a bottom wall joined to define a cavity sized to receive said receptacle, wherein said front wall has a through opening therein, said through opening being dimensioned to accommodate the opening and closing of said cover and dimensioned to generally match the configuration of said cover such that when said receptacle is received within said cavity and said cover is positioned adjacent said through opening, said cover closes access to the interior of said receptacle and may be opened to provide access to the interior of said receptacle.

2. The combination of claim 1, the carrying pouch further including an integral tab projecting from one of said opposed edge walls.

3. The combination of claim 2, the carrying pouch further including a ring receiving member pivotably attached to said tab.

4. The combination of claim 3, the carrying pouch further including a ring releasably attached to said ring receiving member.

* * * * *